US005509586A

United States Patent [19]

Leiser

[11] Patent Number: 5,509,586

[45] Date of Patent: Apr. 23, 1996

[54] BOW MAKING FORM

[76] Inventor: Mary A. Leiser, 5640 Riveredge Rd., Waunakee, Wis. 53597

[21] Appl. No.: 218,349

[22] Filed: Mar. 28, 1994

[51] Int. Cl.[6] ..... A41H 43/00; D04D 7/10

[52] U.S. Cl. ..... 223/46; 28/147

[58] Field of Search ..... 223/46, 44; 28/147, 28/149, 150; 289/17; 2/244; 428/4, 5

[56] References Cited

U.S. PATENT DOCUMENTS

| | | | |
|---|---|---|---|
| Re. 12,479 | 5/1906 | Proctor | 28/150 |
| 689,86 | 12/1901 | Dixon | 223/46 |
| 2,132,265 | 10/1938 | Kowalewska | 28/150 |
| 2,527,752 | 4/1958 | Hanselman | 223/46 |
| 2,660,777 | 12/1958 | Cruz | 223/46 |
| 2,966,759 | 1/1961 | Robertson | 223/46 |
| 3,021,038 | 2/1962 | Dean | 223/46 |
| 3,044,670 | 7/1962 | Barefoot | 223/46 |
| 3,229,870 | 1/1966 | Capstick | 223/46 |
| 3,286,888 | 11/1966 | Cuttler et al. | 223/46 |
| 3,411,677 | 11/1968 | Bickner | 223/46 |
| 3,515,317 | 6/1970 | Bickner | 223/46 |
| 3,530,558 | 9/1970 | Gick | 28/150 |
| 4,651,908 | 3/1987 | Ford | 223/46 |
| 5,094,370 | 3/1992 | Specht | 223/46 |

FOREIGN PATENT DOCUMENTS

| | | | |
|---|---|---|---|
| 3722854 | 7/1987 | Germany | 223/46 |
| 338573 | 3/1936 | Italy | 28/147 |
| 000115 | 8/1902 | Norway | 223/46 |

*Primary Examiner*—Amy B. Vanatta
*Attorney, Agent, or Firm*—DeWitt Ross & Stevens

[57] ABSTRACT

A form for making decorative ribbon bows. The form includes a circular body having a central aperture surrounded by a series of peripheral openings. The peripheral openings are preferably tapered so that they are narrower adjacent the central aperture and wider adjacent the perimeter of the body. A loop of bow material is inserted into each peripheral opening to form the bow. Each peripheral opening may accommodate one or more loops of bow material. The form may separately or simultaneously accommodate different bow materials having different sizes and colors. When the bow is completed, the form remains a permanent part of the bow. The bow may be disassembled so that the form and bow material may be reused.

20 Claims, 3 Drawing Sheets

BOW MAKING FORM

FIELD OF THE INVENTION

The present invention relates generally to an apparatus and method for making decorative bows of various shapes, sizes, colors, and varieties which have a professionally-made appearance, and specifically to an apparatus and method for making decorative bows wherein the apparatus forms a part of the completed bow.

BACKGROUND OF THE INVENTION

The prior art contains several examples of apparatuses and methods for producing decorative bows.

U.S. Pat. No. 3,021,038 to Dean (1962) uses a plastic form to produce bows. The only element of this prior art device common to the present invention is an opening in the center of the form. The form is shaped differently than that of the present invention and the finished bow of the prior art device does not look similar to that of the present invention. Also, the bow of the prior art device has a lump in the bottom caused by stapling, and as a result it will not lie flat.

U.S. Pat. No. 3,229,870 to Capstick (1966) uses a plastic bow-making form which also has a different shape and different method of bow formation than the present invention. This prior art device has long legs with bevels or sharp points on the end of each leg that requires that the ribbon be hung or hooked midway and balanced on the end of a leg. The prior art device is difficult to use with plastic ribbon, which can only be hung around the end of each leg once, and even then with difficulty.

U.S. Pat. No. 4,651,908 to Ford (1987) discloses a form with a circular opening in its middle which facilitates the formation of the bow by allowing stapling through the bow ribbon before removing the ribbon from the form. The legs of the form are sufficiently flexible that when the bow is made, the points may be flexed inward to release the loops of the bow.

The prior art concerning apparatuses and methods for producing decorative bows of professional quality has generally been disappointing to consumers of such decorative bows.

First, the directions for the prior art devices tend to be complex and difficult to understand, resulting in mismade and inferior-looking bows.

Second, some prior art devices are prohibitively expensive for the average consumer of decorative bows. For the average consumer who only needs decorative bows once or twice a year on special occasions, the purchase of an expensive bow-making device is economically unjustifiable.

Third, the prior art apparatuses and methods can only produce a limited number of styles of decorative bows. Each apparatus or method can only use a limited number of materials to produce a limited range of sizes of bows. Some prior art is even limited to making only certain colors of bows.

Fourth, none of the prior art noted above utilize a bow-making form which becomes a permanent part of the completed bow, wherein the completed bow may be left intact for permanent use or disassembled so that the form may be reused to make another bow.

Finally, none of the prior art is directed towards apparatuses or methods for making what are commonly termed "pew bows", i.e. large bows appropriate for use as pew decorations.

In view of the difficulties in making inexpensive decorative bows with aesthetically pleasant appearances, :most consumers simply opt to buy their bows from professional florists or the like, regardless of the higher expense.

SUMMARY OF THE INVENTION

The bow making form of the present invention is directed to a form for making decorative bows from flexible bow material. Such bow material has a width and a length substantially greater than the width. The length of the bow material includes several length portions, each of which is used to form a loop within the completed bow. The form comprises a top face, a bottom face, a generally circular perimeter bounding the top face and the bottom face, and a central core with a central aperture extending from the top face to the bottom face. The form includes a plurality of spaced peripheral openings extending from the top face to the bottom face at positions between the central aperture and the perimeter to define struts between the peripheral openings which extend radially from the central core to the perimeter. Each of the peripheral openings has at least the same size as the central aperture.

The present invention is additionally directed to a method for making decorative bows from flexible bow material and a bow making form. The bow material includes a width and a length, which is substantially larger than the width. The length includes two ends and a plurality of length portions therebetween. The form includes a top face, a bottom face, a generally circular perimeter bounding the top face and the bottom face, a central core, and a plurality of spaced peripheral openings located between the central core and the perimeter and extending from the top face to the bottom face. The method of making decorative bows comprises: doubling a length portion onto itself so as to form the length portion into a loop; inserting the loop into a peripheral opening from the bottom face so that the loop is contained within the peripheral opening and extended from the top face; and forming another length portion into an additional loop and repeating the preceding steps (a) and (b) for an additional peripheral opening within the form.

Besides having the object of overcoming the disadvantages of the prior art noted above, the bow making form of the present invention has several additional objects:

to provide a bow making form that produces bows of professional quality and appearance;

to provide a bow making form that is simple to use by those who are not skilled in the art of bow making, thus eliminating the need for professional bow-making services;

to provide a bow making form that is relatively inexpensive;

to provide a bow making form that eliminates the need for tying or the use of fasteners (e.g. staples, thumbtacks, pegs, or pins) to complete the bow;

to provide a bow making form wherein the completed bow has a flat bottom, allowing its easy affixment to surfaces;

to provide a bow making form that allows flexibility in the size, color, and selection of bow materials;

to provide a bow making form which allows the user to make a single bow which contains a variety of different bow materials of different sizes and colors;

to provide a bow making form wherein the form constitutes an integral part of the completed bow;

to provide a bow making form wherein the bow may be disassembled to remove the form for reuse within a different bow, allowing the form to be recycled rather than discarded;

to provide a bow making form wherein the same form may be used to make differently sized bows;

to provide a bow making form wherein the completed bow has as many layers of loops of bow material as the user desires;

to provide bow making forms of different sizes so that a wide range of differently sized bows may be made; and to provide a bow making form which allows the manufacture of decorative bows for uses such as (but not limited to) pew bows, floral arrangements, holiday wreaths and baskets, candle rings, or decorations for gifts, doors, walls, tables, and the like.

The bow making form of the present invention provides a simple, inexpensive, reusable bow making form that can be used by practically anyone. The bow making form allows greater creativity in bow making because it may use various bow materials (e.g. ribbons) of various colors and sizes to make the bow without the need for fasteners or tying to complete the bow and hold it intact.

Further objects, features and advantages of the invention will be apparent from the following detailed description when taken in conjunction with the drawings.

DETAILED DESCRIPTION OF THE INVENTION

Figure 1:
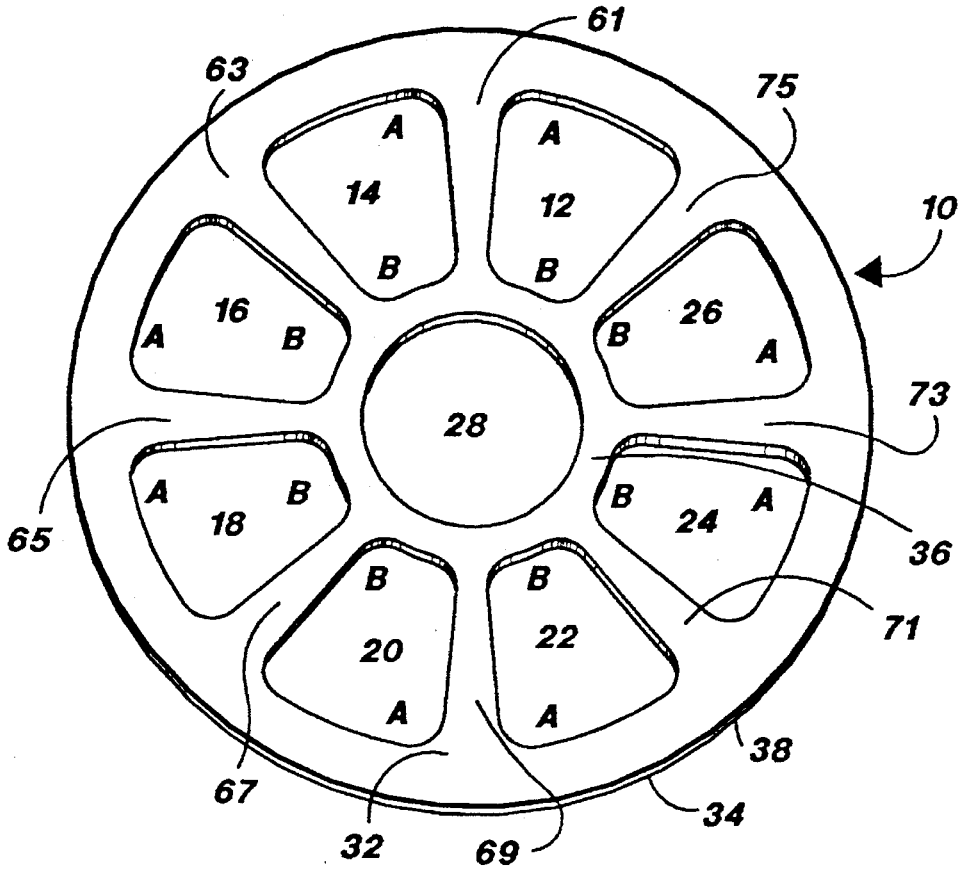
FIG. 1 is a perspective view of the bow making form as seen from the top.

In the drawings, wherein the same or similar features are designated by like reference numerals, the bow making form of the present invention is shown generally at 10.

The form 10 has a generally circular perimeter 38 bounding a top face 32 and a bottom face 34. The form 10 includes a central core 36 wherein a central aperture 28 extends from the top face 32 to the bottom face 34. A plurality of peripheral openings 12, 14, 16, 18, 20, 22, 24 and 26 are located between the central core 36 and the perimeter 38. These peripheral openings 12–26 extend from the top face 32 to the bottom face 34, and are preferably arranged symmetrically about the central aperture 28 between the central core 36 and the perimeter 38. The peripheral openings 12–26 are also preferably spaced at equal distances from the central aperture 28, and evenly about the form 10 so that each is the same distance from its adjacent peripheral openings. The peripheral openings 12-26 within the form 10 define the struts 61, 63, 65, 67, 69, 71, 73, and 75, which extend from the central core 36 toward the perimeter 38.

As will be described below, the peripheral openings 12–26 will hold the peripheral loops of the completed bow, and the central aperture 28 will hold one or more central loops. Certain configurations of peripheral openings 12–26 have been found to hold bow material better than others. The peripheral openings 12–26 are ideally shaped trapezoidally, with a larger width A located near the outer edge of the form 10 which gradually narrows in size toward a smaller width B located near the central aperture 28. Since the peripheral openings 12–26 will generally hold more loops than the central aperture 28, the peripheral openings 12–26 are preferably the same size as, or slightly larger than, the central aperture 28.

The preferred embodiment of the bow making form 10 is a piece of plastic approximately 2 mm thick, with a generally circular perimeter and a radius of about 7 cm. The peripheral openings 12–26 have an area of approximately 4.5 $cm^2$, and the central aperture 28 has an area of approximately 4 $cm^2$. This sizing has been found to produce a well-proportioned bow having a professionally-made appearance when bow materials with widths of 8–15 cm are used within the form 10. If narrower or wider bow materials 30 are to be used within the form 10, good results are obtained with forms 10 sized proportionately to the preferred embodiment.

The description of the preferred embodiment of the form 10 should not be construed as limiting the scope of the invention as to its size, shape, or material of the form 10, but as merely providing an illustration of the presently preferred embodiment of the invention. Alternate embodiments of the form 10 are contemplated and function equally well as the preferred embodiment. For example, the form 10 may have a different size, as may the central aperture 28 and the peripheral openings 12–26. Similarly, the form 10, central aperture 28, and the peripheral openings 12–26 may be differently shaped (e.g. circles, pear-shapes, teardrops, ovals, etc.). The number of peripheral openings 12–26 and struts 61–75 may vary.

The operation of the bow making form 10 is outlined as follows. First, the user must obtain a piece of flexible bow material 30 having a ribbon-like shape, with a length generally much greater than its width. The bow material 30 illustrated in FIGS. 2–6 is, for example, a piece of fabric approximately 11 cm wide and about 5 m long. This material 30 and its associated dimensions are chosen for the example because the material 30, when used with the preferred embodiment of the bow making form 10 as shown in FIG. 1, forms a well-bodied bow measuring approximately 27 cm in diameter with two layers of fabric loops. However, the user can use any length or type of bow material 30 depending upon the size of bow desired.

Figure 2:
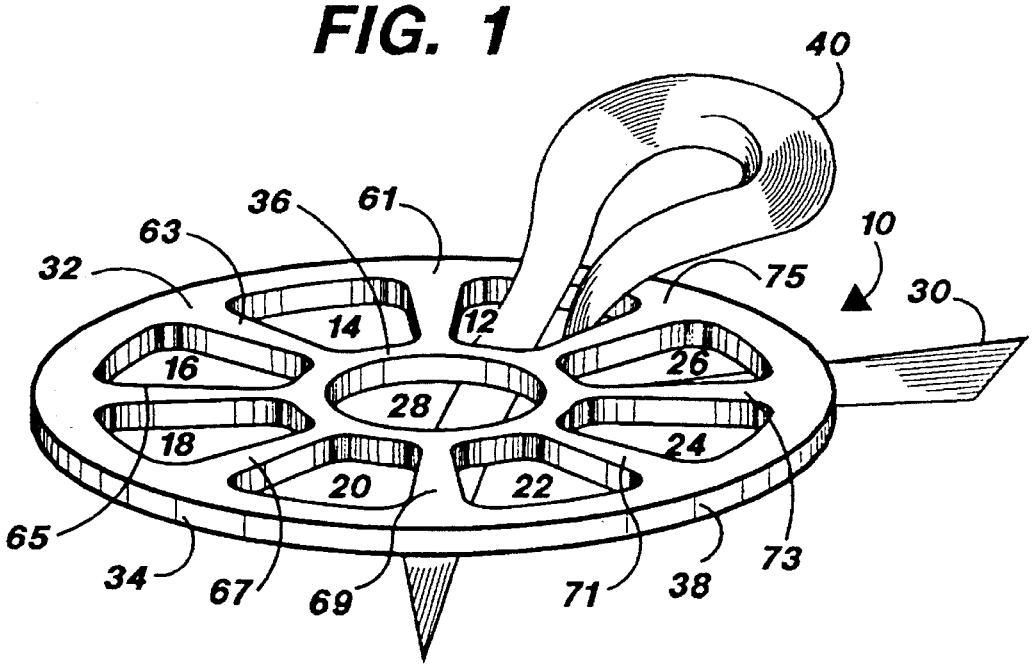
FIG. 2 is a perspective view of the bow making form of FIG. 1 including a bow ribbon inserted in the first peripheral opening of the bow making form.
Figure 3:
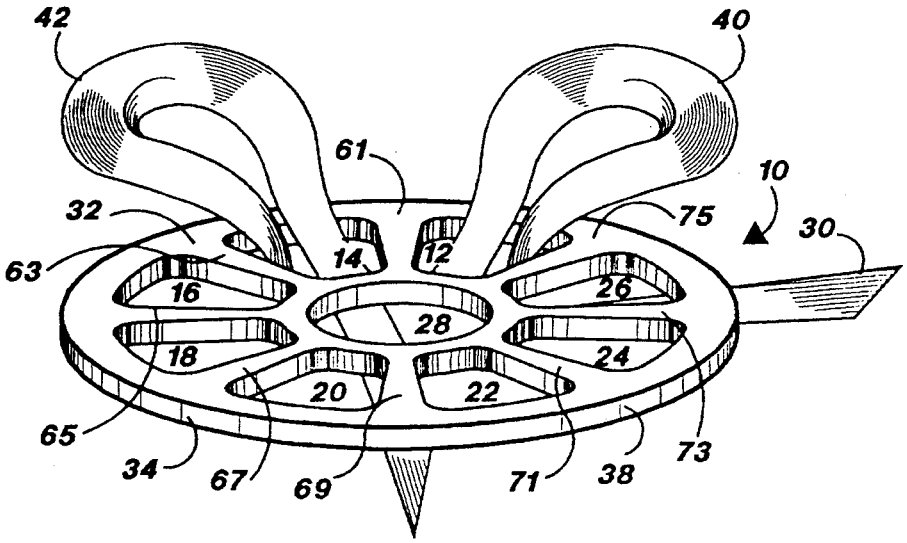
FIG. 3 is a perspective view of the bow making form of FIG. 1 including a bow ribbon inserted in the first and second peripheral openings of the bow making form.
Figure 4:
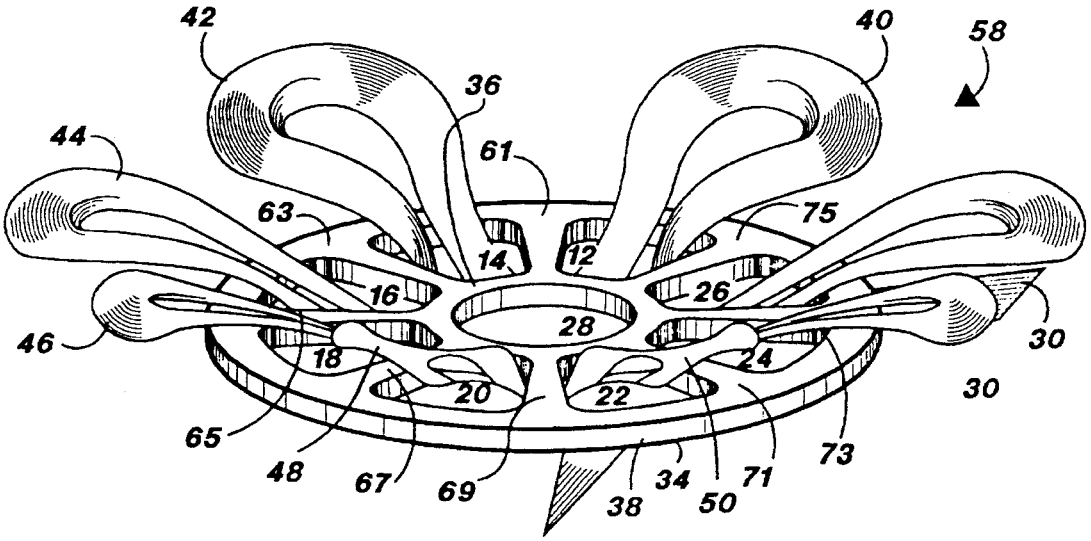
FIG. 4 is a perspective view of the bow making form of FIG. 1 including a bow ribbon inserted in all of the peripheral openings of the bow making form.
Figure 5:
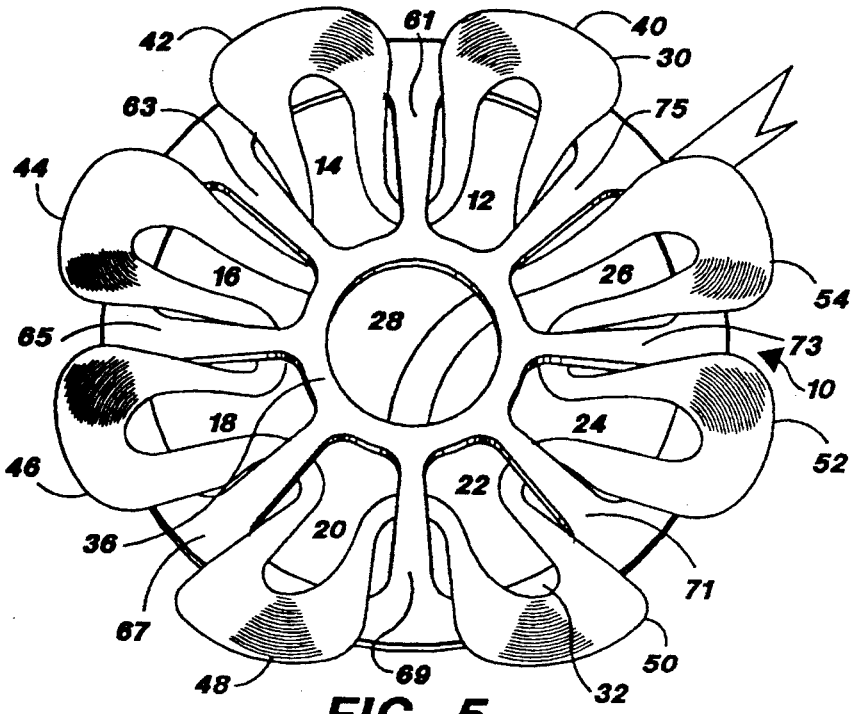
FIG. 5 is a another perspective view of the bow making form of FIG. 4.

FIG. 2 illustrates the creation of the first of several bow loops within a bow. The user simply inserts the material 30 within a peripheral opening 12 of the form 10 from the bottom face 34 of the form 10 to form a loop 40 which protrudes from the top face 32. The material 30 is inserted through the bottom face 34 of the form 10 and pulled through the top face 32 of the form 10 until the loop 40 reaches the desired size. The user then measures another length from the material 30 for the next loop 42 of the bow and inserts this length in an adjacent peripheral opening 14 from the bottom face 34 to form the next loop 42, as shown in FIG. 3. Slack in the material 30 at the bottom face 34 of the form 10 may be taken up by holding the first loop 40 and pulling the adjacent loop 42. This removal of slack at the bottom face 34 allows the completed bow to lie on a flat surface with no lumps underneath. The procedure is then repeated for the remaining six peripheral openings 16–26, as shown in FIGS. 4 and 5. Loops 44, 46, 48, 50, 52, and 54 are sequentially formed and inserted within peripheral openings 16, 18, 20, 22, 24, and 26, thereby completing a bow 58 with a single layer of material 30 loops.

Any material 30 not used for loops within the bow 58 may be cut off or used as a streamer. However, if bows with multiple layers of loops are desired, the user can then go around the form 10 again, inserting additional material 30 within the peripheral openings 12–26 as many times as the size of the peripheral openings 12–26 will accommodate. The second layer of loops may be sized differently from the first layer of loops. Tapered peripheral openings 12–26, having a trapezoidal or similar shape wherein the peripheral openings are narrower adjacent the central aperture 28, are helpful because they hold the material as the peripheral openings 12–26 are filled with material from their inner sides B near the central aperture 28 to their outer sides A adjacent the perimeter of the form 10.

Figure 6:
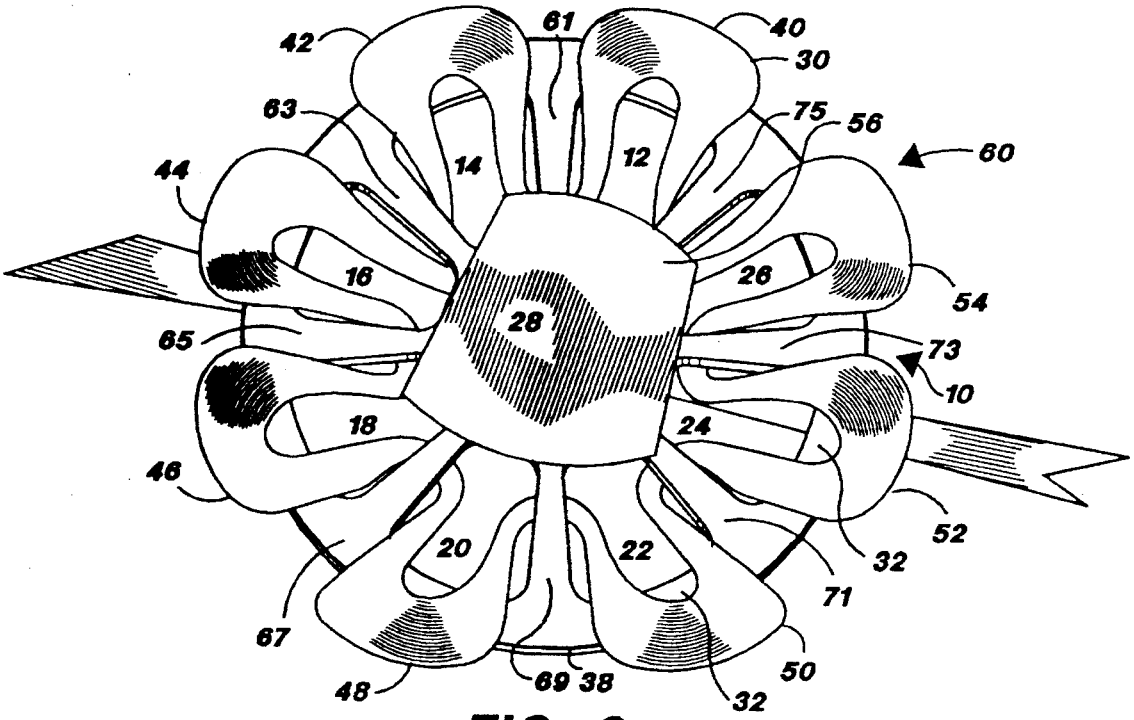
FIG. 6 is a perspective view of the bow making form of FIG. 1 wherein a bow ribbon has been inserted in all of the peripheral openings of the bow making form and also within the central aperture of the bow making form.

At some point, if the user so desires, the user can insert a loop 56 of the material 30 through the central aperture 28 using the same procedure as with the peripheral openings 12–26. As shown in FIG. 6, this creates body in the center of the bow 58. This step is preferably done when almost all of the length of the bow material 30 has been inserted within some or all of the peripheral openings 12–26, and only a small length of excess material remains, enough to insert within the central aperture 28 plus a little extra length. The extra length can then function as a streamer. Alternatively, it may simply be cut off.

In addition, when the basic bow 58 has been completed as detailed above, the entire procedure can be repeated with another length of different material 30. The loops of the different material 30 may be larger or smaller than the previous loops to suit the user's preference. As discussed above, the material 30 is inserted through the peripheral openings 12–26 from the larger portion A of the peripheral openings and tucked down to the smaller portion B of the peripheral openings, thus causing the smaller portion B to hold the material 30 in place.

Once the above steps are completed, the user can then straighten or fluff the loops of material to create the desired appearance in the bow 58. Any remaining length of material can be used as a streamer or cut off. An exemplary completed bow 60 with a single layer of loops is shown in FIG. 6.

If the user wishes, the bow 60 may later be taken apart by pulling the material 30 loops from the peripheral openings 12–26 and/or the central aperture 28. Both the form 10 and the material 30 may then be retained for reuse. The form 10 can be used to make another bow 60 with either the same or different material 30.

It is understood that the invention is not confined to the particular construction and arrangement of parts herein illustrated and described, but embraces such modified forms thereof as come within the scope of the following claims.

I claim

1. A form for making decorative bows from flexible bow material having a width and a length substantially greater than the width and including several length portions, the form comprising a top face, a bottom face, a generally circular perimeter bounding the top face and the bottom face, and a central core with a central aperture extending from the top face to the bottom face, the form including a plurality of spaced peripheral openings extending from the top face to the bottom face at positions between the central aperture and the perimeter to define struts between the peripheral openings which extend radially from the central core to the perimeter, wherein the peripheral openings each have at least the same size as the central aperture and wherein the peripheral openings are tapered in a radial direction from the central core to the perimeter so as to be narrower adjacent the central aperture and wider adjacent the perimeter.

2. The form of claim 1 wherein the peripheral openings have a trapezoidal shape.

3. The form of claim 1 wherein the peripheral openings are spaced evenly between the central aperture and the perimeter.

4. The form of claim 1 wherein the peripheral openings are each spaced equidistantly from their immediately adjacent peripheral openings.

5. The form of claim 1 wherein the peripheral openings are arranged symmetrically about the central aperture.

6. The form of claim 1 including at least six peripheral openings.

7. The form of claim 1 including eight peripheral openings.

8. The form of claim 1 wherein the form is made of plastic.

9. The form of claim 1 in combination with flexible bow material having a width and a length substantially greater than the width, the length including length portions which are folded upon themselves to form loops, each loop entering a peripheral opening from the bottom face and extending from the top face.

10. The form of claim 9 wherein the length includes an additional length portion which is folded upon itself to form an additional loop, the additional loop entering the central aperture from the bottom face and extending from the top face.

11. A method for making decorative bows from a flexible piece of bow material and a bow making form, the piece of bow material including a width and a length which is substantially larger than the width, the length including two ends and a plurality of length portions therebetween, and the form including a top face, a bottom face, a generally circular perimeter bounding the top face and the bottom face, a central core, and a plurality of spaced peripheral openings located between the central core and the perimeter and extending from the top face to the bottom face, the method comprising:

(a) doubling a length portion onto itself so as to form the length portion into a loop;

(b) inserting the loop into a peripheral opening from the bottom face so that the loop is contained within the peripheral opening and extended from the top face;

(c) forming another length portion and repeating the preceding steps (a) and (b) for an additional peripheral opening within the form.

12. The method of claim 11 wherein step (c) is performed until all peripheral openings contain at least one loop.

13. The method of claim 11 wherein step (c) is performed until all peripheral openings contain two loops.

14. The method of claim 11 followed by the step of repeating steps (a), (b), and (c) using a second piece of bow material which includes a width and a length which is substantially larger than the width, the length including two ends and a plurality of length portions therebetween.

15. The method of claim 14 wherein the piece of bow material has length portions which are different in size than the length portions of the second piece of bow material.

16. The method of claim 14 wherein the piece of bow material has a different width than the second piece of bow material.

17. The method of claim 14 wherein the piece of bow material has a different length than the second piece of bow material.

18. The method of claim 14 wherein the piece of bow material has a different color than the second piece of bow material.

19. The method of claim 11 wherein the piece of bow material is the same color as the color of the form.

20. The method of claim 11 performed with a form which further includes a central aperture at the central core, the central aperture extending from the top face to the bottom face, the method further comprising the steps of (a) doubling a length portion onto itself so as to form the length portion into a loop;

(b) inserting the loop into the central aperture from the bottom face so that the loop is contained within the central aperture and extended from the top face.

* * * * *